US011136790B2

(12) United States Patent
Caterino et al.

(10) Patent No.: US 11,136,790 B2
(45) Date of Patent: Oct. 5, 2021

(54) PROGRESSIVE DEADLATCHING FOR DEADBOLTS

(71) Applicant: ASSA ABLOY Residential Group, Inc., New Haven, CT (US)

(72) Inventors: Mark Caterino, Prospect, CT (US); John E. Walsh, III, Wallingford, CT (US); Brian R. Fournier, Canton, CT (US); Wai P. Wong, Orange, CT (US)

(73) Assignee: ASSA ABLOY Residential Group, Inc., New Haven, CT (US)

( * ) Notice: Subject to any disclaimer, the term of this patent is extended or adjusted under 35 U.S.C. 154(b) by 299 days.

(21) Appl. No.: 16/202,465

(22) Filed: Nov. 28, 2018

(65) Prior Publication Data

US 2019/0178005 A1 Jun. 13, 2019

Related U.S. Application Data

(60) Provisional application No. 62/596,590, filed on Dec. 8, 2017.

(51) Int. Cl.

| | |
|---|---|
| ***E05B 47/06*** | (2006.01) |
| ***E05B 17/20*** | (2006.01) |
| *E05B 47/00* | (2006.01) |

(52) U.S. Cl.

CPC ..... *E05B 47/0607* (2013.01); *E05B 17/2034* (2013.01); *E05B 17/2049* (2013.01); *E05B 2047/0084* (2013.01); *E05Y 2900/132* (2013.01)

(58) Field of Classification Search

CPC ..... E05B 47/0607; E05B 17/2034; E05B 17/2049; E05B 2047/0084; E05B 15/0046; E05B 17/2053

USPC ..... 70/134, 416–418, DIG. 9; 292/169.14, 292/169.15, 337

See application file for complete search history.

(56) References Cited

U.S. PATENT DOCUMENTS

| | | | | |
|---|---|---|---|---|
| 2,181,313 A | | 11/1939 | Blodgett | |
| 2,484,571 A | | 10/1949 | Jozefowicz | |
| 3,148,524 A | | 9/1964 | Yulkowski | |
| 4,389,061 A | | 6/1983 | Foshee | |
| 4,657,206 A | * | 4/1987 | Matsumoto | E05B 17/22 292/150 |
| 4,674,776 A | | 6/1987 | James | |

(Continued)

FOREIGN PATENT DOCUMENTS

| | | |
|---|---|---|
| AU | 2007219334 A1 | 4/2008 |
| WO | WO 2015/058252 A1 | 4/2015 |

OTHER PUBLICATIONS

International Preliminary Report on Patentability for International Application No. PCT/US2018/028066, dated Oct. 31, 2019.

(Continued)

*Primary Examiner* — Lloyd A Gall

(74) *Attorney, Agent, or Firm* — Wolf, Greenfield & Sacks, P.C.

(57) ABSTRACT

A progressive deadlatching arrangement for a deadbolt lock prevents an external force applied on the deadbolt from retracting the deadbolt or otherwise compromising a secured door. The progressive deadlatching arrangement prevents external forces from retracting the deadbolt while still allowing an authorized user to operate the deadbolt. ASSA ABLOY Residential Group, Inc. is a subsidiary of ASSA ABLOY AB.

17 Claims, 8 Drawing Sheets

(56) References Cited

U.S. PATENT DOCUMENTS

| | | | | |
|---|---|---|---|---|
| 4,870,841 | A | 10/1989 | Cudd | |
| 4,890,870 | A | 1/1990 | Miron | |
| 4,945,737 | A * | 8/1990 | Hart | E05B 55/005 292/167 |
| 4,950,005 | A | 8/1990 | Cudd | |
| 5,267,457 | A | 12/1993 | Sorensen et al. | |
| 5,377,513 | A * | 1/1995 | Miyamoto | E05B 47/0607 70/276 |
| 5,678,870 | A | 10/1997 | Pelletier | |
| 5,918,916 | A * | 7/1999 | Kajuch | E05B 63/202 292/163 |
| 5,941,581 | A | 8/1999 | Heithe | |
| 6,212,923 | B1 | 4/2001 | Clark | |
| 6,302,456 | B1 | 10/2001 | Errani | |
| 6,578,888 | B1 | 6/2003 | Fayngersh et al. | |
| 7,007,985 | B2 | 3/2006 | Alexander et al. | |
| 7,155,946 | B2 | 1/2007 | Lee et al. | |
| 7,303,215 | B2 | 12/2007 | Moon et al. | |
| 7,431,354 | B2 | 10/2008 | Raatikainen | |
| 7,866,713 | B2 | 1/2011 | Chen | |
| 10,508,472 | B2 | 12/2019 | Piantek | |
| 2002/0101083 | A1 | 8/2002 | Toledano et al. | |
| 2003/0127866 | A1* | 7/2003 | Martinez | E05B 17/0029 292/216 |
| 2004/0045330 | A1 | 3/2004 | Moon et al. | |
| 2005/0046198 | A1 | 3/2005 | Alexander et al. | |
| 2006/0123859 | A1 | 6/2006 | Gonzalez | |
| 2009/0151407 | A1 | 6/2009 | Lin | |
| 2009/0151408 | A1 | 6/2009 | Petry | |
| 2012/0167646 | A1 | 7/2012 | Sharma et al. | |
| 2016/0189503 | A1 | 6/2016 | Johnson et al. | |
| 2017/0228603 | A1 | 8/2017 | Johnson | |
| 2017/0362856 | A1 | 12/2017 | Almomani et al. | |
| 2018/0298640 | A1 | 10/2018 | Caterino | |
| 2018/0320414 | A1 | 11/2018 | Piantek | |
| 2020/0123808 | A1 | 4/2020 | Lovejoy et al. | |

OTHER PUBLICATIONS

International Preliminary Report on Patentability for International Application No. PCT/US2018/062738, dated Jun. 18, 2020.
International Preliminary Report on Patentability for International Application No. PCT/US2018/031391, dated Nov. 21, 2019.
Invitation to Pay Additional Fees for International Application No. PCT/US2018/028066, dated Jun. 27, 2018.
International Search Report and Written Opinion for International Application No. PCT/US2018/028066, dated Aug. 29, 2018.
International Search Report and Written Opinion for International Application No. PCT/US2018/031391, dated Aug. 9, 2018.
International Search Report and Written Opinion for International Application No. PCT/US2018/062738, dated Feb. 11, 2019.

* cited by examiner

PROGRESSIVE DEADLATCHING FOR DEADBOLTS

RELATED APPLICATIONS

This Application claims the benefit of U.S. Provisional Application No. 62/596,590, filed Dec. 8, 2017, entitled "PROGRESSIVE DEADLATCHING FOR DEADBOLTS". The entire contents of this application are incorporated herein by reference in their entirety.

FIELD

Disclosed embodiments are related to progressive deadlatching for deadbolts.

BACKGROUND

Traditionally, deadbolt locks are used to secure access points (e.g., doors, windows, etc.) from unauthorized entry. These deadbolt locks are conventionally unlocked with a key or other valid credential, such that an authorized user can enter or exit through the access point. Conventional deadbolts of such locks extend into an associated jamb adjacent the access point.

SUMMARY

According to one aspect, a deadbolt for an access point is disclosed. The deadbolt includes a deadbolt head constructed and arranged to move between an extended position and a retracted position and a deadbolt arm constructed and arranged to move in a locking direction and an unlocking direction. Moving the deadbolt arm in the locking direction moves the deadbolt head from the retracted position to the extended position, and moving in the deadbolt arm in the unlocking direction moves the deadbolt head from the extended position to the retracted position. The deadbolt also includes a progressive deadlatching arrangement cooperating with the deadbolt arm. The progressive deadlatching arrangement includes a plurality of locking regions, and the plurality of locking regions are constructed and arranged to engage the deadbolt arm when the deadbolt head is initially moved toward the retracted position by a force applied to the deadbolt head in a direction toward the retracted position. The plurality of locking regions are constructed and arranged to substantially prevent the deadbolt head from continuing to move toward the retracted position.

According to another aspect, a deadbolt lock for an access point is disclosed. The deadbolt lock includes a chassis and a deadbolt supported by the chassis. The deadbolt includes a deadbolt head constructed and arranged to move between an extended position and a retracted position and a deadbolt arm constructed and arranged to move in a locking direction and an unlocking direction. Moving the deadbolt arm in the locking direction moves the deadbolt head from the retracted position to the extended position, and moving in the deadbolt arm in the unlocking direction moves the deadbolt head from the extended position to the retracted position. The deadbolt also includes a progressive deadlatching arrangement cooperating with the deadbolt arm. The progressive deadlatching arrangement includes a plurality of locking regions, and the plurality of locking regions are constructed and arranged to engage the deadbolt arm when the deadbolt head is initially moved toward the retracted position by a force applied to the deadbolt head in a direction toward the retracted position. The plurality of locking regions are constructed and arranged to substantially prevent the deadbolt head from continuing to move toward the retracted position.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1A:
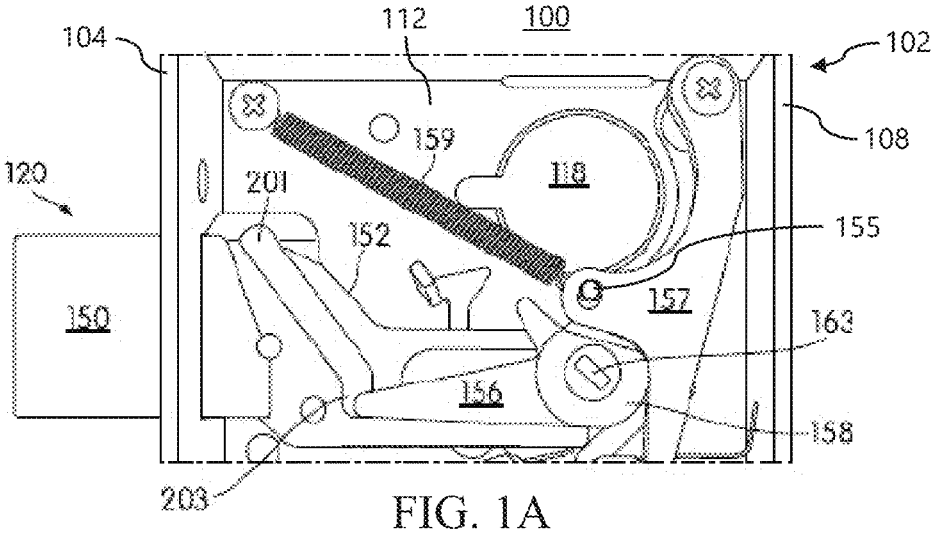
FIGS. 1A-1C are side views of an embodiment of a portion of a conventional deadbolt lock.

In order to prevent a deadbolt lock from being manipulated to push the deadbolt with an external force, some conventional deadbolt locks include a deadlatching arrangement that prevents a fully extended deadbolt from being retracted by any external forces. However, the inventors have recognized that these conventional deadlatching arrangements require the deadbolt to be fully extended, and thus may be compromised if the deadbolt is not fully extended. Accordingly, the inventors have recognized the benefits of a progressive deadlatching arrangement for deadbolt locks which prevents the deadbolt from being retracted by any external forces when the deadbolt is in any of its extended positions between the fully retracted position and the fully extended position.

According to one embodiment, a deadbolt for an access point (e.g., a door) includes a deadbolt head, a deadbolt arm, and a sliding mechanism including a cam slot. The deadbolt head may be constructed and arranged to be moved between an extended position and a retracted position. The deadbolt arm may be constructed and arranged to move in a locking direction or an unlocking direction. The deadbolt arm may operatively connect to the cam slot of the sliding mechanism, such that rotation of the deadbolt arm causes a camming action in the cam slot which moves the deadbolt head between an extended position and a retracted position. Thus, when rotated in a locking direction, the deadbolt arm moves the deadbolt head to the extended position, and when rotated in an unlocking direction, the deadbolt arm moves the deadbolt head to the retracted position.

The deadbolt may also include a progressive deadlatching arrangement, which prevents the deadbolt head from moving towards the retracted position from external force (i.e., force generated outside of the deadbolt mechanism) applied on the deadbolt head. The deadlatching arrangement may be any suitable arrangement and operatively connect to any element of the deadbolt such that retraction of the deadbolt head by an external force is substantially prevented.

In some embodiments, the progressive deadlatching arrangement may include a plurality of locking regions corresponding to a plurality of deadbolt extended positions, such that an external force applied to a deadbolt head does not substantially retract the deadbolt. According to this embodiment, a sliding mechanism may include a plurality of teeth which function as the locking regions and a deadbolt arm may include a projection (e.g., a pin) positioned in the sliding mechanism. The projection may be arranged to engage with each of the plurality of locking regions as the deadbolt arm is moved in a locking direction. As the projection mates with each of the plurality of locking regions, the engaged locking region may substantially redirect any external force applied on the deadbolt head in a direction that prevents movement of the deadbolt arm in an unlocking direction. According to this embodiment, the plurality locking regions may allow the external force to be transferred to a door or other support location through the deadbolt arm, such that the deadbolt head remains extended the door remains secure. In some embodiments, the deadbolt arm may be moved in an unlocking direction independent of the deadbolt head to disengage the projection from the plurality of locking regions such that the deadbolt arm may be moved in the unlocking direction to retract the deadbolt. Thus, the deadbolt may be operable from the deadbolt arm, while still providing progressive deadlatching that resists external force applied to the deadbolt head. Of course, the progressive deadlatching arrangement and deadbolt arm may be employed in any suitable arrangements such that the dead bolt arm engages one of the plurality locking regions to prevent unauthorized retraction of the deadbolt head.

According to yet another embodiment, the progressive deadlatching arrangement may include a cam block located in a slot of a sliding mechanism. A deadbolt arm may include a projection positioned in a sliding mechanism adjacent to the cam block. The cam block may include a notch, and the projection may be located adjacent the notch such that the projection is located between the cam block and a side of the slot. According to this embodiment, movement of the deadbolt arm in the locking direction may move the cam block in the slot as a deadbolt head is extended. Additionally, the deadbolt arm may be moved in the unlocking direction to move the cam block in the cam slot as the deadbolt head is retracted, during which the projection of the deadbolt arm contacts the notch of the cam block and moves out of contact with the side of the slot. In this arrangement, when any external force is applied on the deadbolt head that may cause the deadbolt head to retract, the cam block may move the projection into contact with both the side of the slot and the notch of the cam block, such that the deadbolt arm is prevented from being moved in the unlocking direction. That is, the external force may cause a wedging action where the projection moves between the side of the slot and the cam block such that resistive forces (i.e., frictional and normal forces) are generated by the slot and cam block to prevent the deadbolt arm from moving further in the unlocking direction. Thus, the deadbolt head is unable to retract without movement of the deadbolt arm independent of the deadbolt head in the unlocking direction. In some embodiments, the deadbolt arm may be moved in a locking direction independent of the deadbolt head such that the projection is moved out of contact with at least one of the cam block and side of the cam slot. Following the movement of the projection out of the wedge, the deadbolt arm may then be moved in unlocking direction such that the projection is brought into contact with the cam block to retract the deadbolt without causing a wedging action. Without wishing to be bound by theory, such an arrangement may not have discrete locking regions, and as such may provide an infinite amount of locking regions from the retracted position to and including the fully extended position at which the deadbolt head is substantially prevented from being retracted.

According to yet another embodiment, the deadbolt lock may include authentication device that cooperates with a deadbolt arm, such that an authorized user may be granted access to move the deadbolt arm in a locking or unlocking direction with a valid credential. The authentication device may be any suitable device that may verify a valid credential that identifies an authorized user. In some embodiments, the authentication device may be positioned on an exterior of a door including the deadbolt lock, such that the authentication device is accessible to users while in an unsecured space. Of course, the authentication device may be disposed in any suitable location such that an authorized user may verify a valid credential to be granted access to move the deadbolt arm. In some embodiments, the authentication device may be a lock cylinder positioned on the deadbolt arm, such that a user may use a key to gain access to move the deadbolt arm in the locking or unlocking direction. While a lock cylinder may be used in some embodiments, any suitable authentication device that identifies an authorized user may be employed, including, but not limited to, a keypad, RFID scanner, Bluetooth authenticator, Internet authenticator, blockchain authenticator, or biometric scanner. In some embodiments, the authentication device may be mechanically coupled to the deadbolt arm, such that verification of a valid credential moves the deadbolt arm in the locking or unlocking direction.

According to yet another embodiment, the deadbolt lock may include an actuator that cooperates with an authentication device and a deadbolt arm to move the deadbolt arm in a locking or unlocking direction. The authentication device may include any suitable automatic or manual actuator that may cooperate with the authentication device to move the deadbolt arm, including, but not limited to, a handle, knob, motor, servo, or linear actuator. Accordingly, a user may enter a valid credential (e.g., a key, RFID, biometric reading, code, etc.) that identifies a user as an authorized user, and subsequently move the deadbolt arm in a locking direction or unlocking direction either manually or automatically. In some embodiments, the actuator of the authentication device may be operatively uncoupled from the deadbolt arm whenever a valid credential is not received by the authentication device, so that a user may not move the deadbolt arm without a valid credential. In certain embodiments, the actuator of the authentication device may be operatively uncoupled from the deadbolt arm on an exterior side of the door if no valid credential is received by the authentication device, while the actuator remains coupled to the deadbolt arm on an interior side of the door. According to this embodiment, a user may be able to move the deadbolt arm from the interior side of the door (i.e., a secured space) without a valid credential which may simplify the locking operation for an authorized user who is already inside of the secured space. In some embodiments, the actuator may be electronically controlled, such that authentication at the authentication device causes the actuator to move the deadbolt arm to a locked position or an unlocked position. In other embodiments, the actuator may be electronically controlled, such that authentication at the authentication devices enables the actuator to be moved manually by the user. Of course, any suitable arrangement of the authentication device and actuator may be employed, such that the deadbolt arm may be moved in a locking or unlocking direction by an authorized user while an unauthorized user is prevented from moving the deadbolt arm. In combination with a deadlatching arrangement, the door may be secured from unauthorized access by substantially preventing the retraction of a deadbolt head without use of a valid credential.

According to yet another embodiment, an access point (e.g., a door) may include a deadbolt lock having a deadbolt head, a deadbolt arm, and a deadlatching arrangement. The door may be constructed and arranged to support the deadbolt lock in any suitable form factor, such that the door may be secured by the deadbolt lock when the deadbolt is in an extended position. In some embodiments, the deadbolt may be mounted in a chassis of the lock. In some embodiments, the deadbolt lock may be configured as a mortise lock. According to this embodiment, the door may have a pocket cut in to the edge of the door that mates with an associated door jamb, such that the chassis can be inserted into the pocket and be rigidly attached to the door. In other embodiments, the deadbolt may be mounted in a cylindrical deadbolt lock or a tubular chassis deadbolt lock, such that the deadbolt may be mounted in a corresponding cylindrically bored hole in the door. Of course, the deadbolt may be mounted in any suitable lock or latch assembly such that it can be mounted in the door and the access point can be secured by the deadbolt head.

Figure 1B:
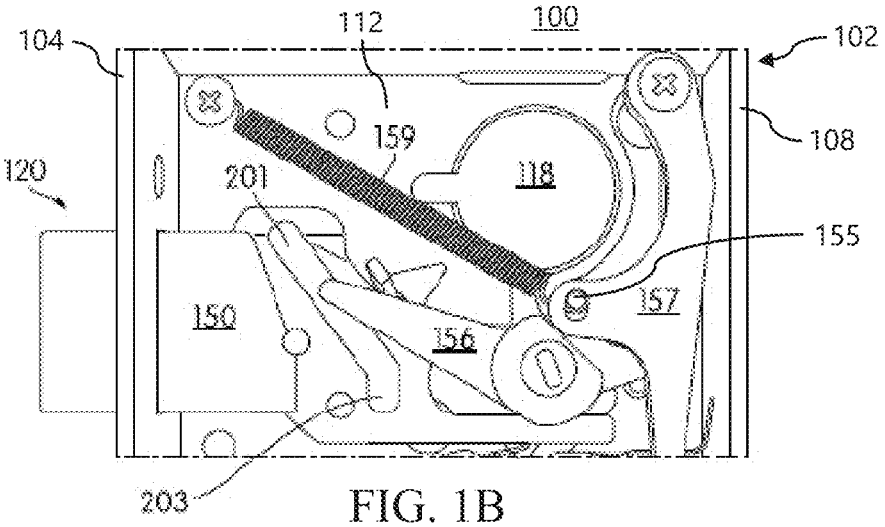
Figure 1C:
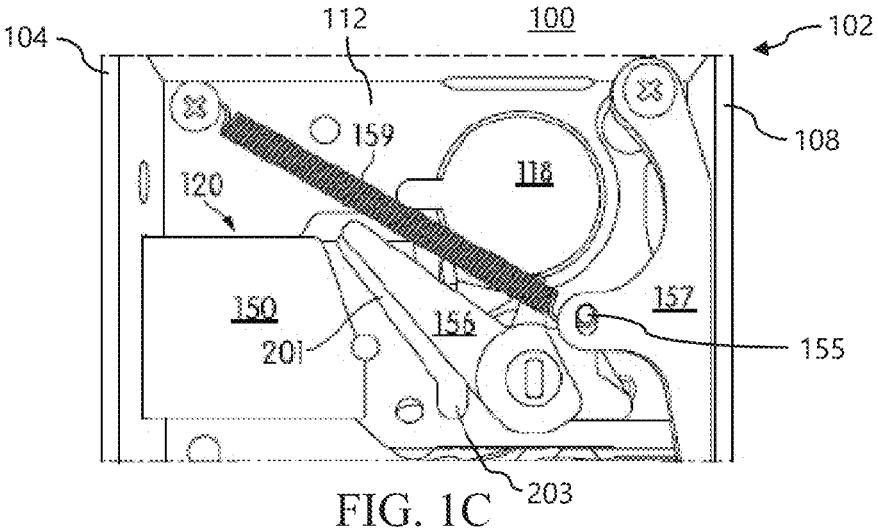

Now turning to the figures, FIGS. 1A-1C depict side views of an embodiment of a deadbolt lock 100 having a deadbolt 120 with a non-progressive deadlatching arrangement. According to this embodiment the deadbolt 120 is mounted in a chassis 102 of a mortise deadbolt lock 100 for a door including a front plate 104, back plate 108, and side plates 112 (one side plate is omitted to expose the deadbolt). The deadbolt 120 includes a deadbolt head 150, a sliding mechanism 152, and a deadbolt arm 156. The sliding mechanism 152 is connected to the deadbolt head 150 and is arranged to move with the deadbolt head in an extending direction (i.e., out of the lock) and a retracting direction (i.e., into the lock). That is, in the extended position the deadbolt head substantially projects out of the lock or an associated door, and in a retracted position the deadbolt head is substantially contained by the lock or associated door. The sliding mechanism also includes a cam slot 201 by which the deadbolt arm is operatively coupled to the sliding mechanism. The deadbolt arm includes a projection (e.g., a pin) that projects into the cam slot 201, thereby operatively coupling the deadbolt arm to the sliding mechanism.

According to the present embodiment, the deadbolt arm 156 may be rotated in a locking direction (i.e., counterclockwise direction) to move the deadbolt head 150 in the extending direction. Additionally, the deadbolt arm may be rotated in an unlocking direction (i.e., clockwise direction) to move the deadbolt in the retracting direction. Of course, the locking and unlocking directions may be any suitable directions such that moving the deadbolt arm in the locking direction moves the deadbolt head in the extending direction and moving the deadbolt arm in the unlocking direction moves the deadbolt head in the retracting direction. As the deadbolt arm is moved, the projection (not shown in the figure) is constructed and arranged to contact at least one side of the sliding mechanism 152 to create a camming motion that moves the deadbolt head in the extending or the retracting direction. As shown in the figure, the cam slot 201 is inclined, such that the contact between the projection and the cam slot creates longitudinal motion of the sliding mechanism and deadbolt head (i.e. in the extending or retracting direction). Accordingly, when the deadbolt arm rotates in a locking direction, the projection abuts and moves down along the cam slot to move the deadbolt head in an extending direction. Similarly, when the deadbolt arm rotates in an unlocking direction, the projection abuts and moves up along the cam slot to move the deadbolt head in a retraction direction. Of course, any suitable arrangement of the deadbolt arm and sliding mechanism may be employed such that moving the deadbolt arm in a locking direction extends the deadbolt head, and moving the deadbolt arm in an unlocking direction retracts the deadbolt head.

As depicted in the present embodiment, the deadbolt 120 includes a non-progressive deadlatching arrangement configured here as a lower cam slot 203 disposed in sliding mechanism 152 and in communication with cam slot 201. As shown in the figures, the lower cam slot is vertically oriented, such that any normal force provided by the lower cam slot is in a substantially horizontal direction (i.e., in the extending direction or retracting direction). Thus, when the projection of the deadbolt arm is lowered into the lower cam slot as the deadbolt head 150 is extended (see FIG. 1A), the lower cam slot prevents force on the deadbolt head from moving the deadbolt arm in an unlocking direction. That is, any externally applied force on the deadbolt head is transmitted horizontally to the deadbolt arm, such that no force is transmitted by the lower deadbolt slot in a direction that may move the deadbolt arm in an unlocking direction. Accordingly, such an arrangement will substantially prevent any external force from retracting the deadbolt head or otherwise unlocking an associated door when the deadbolt is fully extended. In this embodiment, the deadbolt arm is rotated to a locked position for deadlatching, such that the deadbolt head is fully extended and the projection is in the lower deadbolt slot. Accordingly, in positions where the deadbolt arm is not in the locked position (i.e., the projection is not in lower cam slot 203) and the deadbolt head is partially extended, external force may be able to retract from external force on the deadbolt head, thereby compromising the overall security of the deadbolt.

As shown in the figure, the deadbolt lock 100 includes an authentication device constructed and arranged here as a key slot 163 which cooperates with deadbolt arm 156 to move the deadbolt arm in the locking or unlocking direction. The deadbolt also includes an actuator 158 operatively connected to the key slot and the deadbolt arm. According to this embodiment, the key slot is arranged to receive a key (not shown in the figure) by which an authorized user may move the actuator which transfers to the motion of the key to the deadbolt arm to move the deadbolt arm in a locking or unlocking direction. That is, an authorized user with a key may rotate the key in the key slot 163 to move the deadbolt arm 156 in a locking or unlocking direction, thereby moving the deadbolt head to an extended or retracted position respectively. The actuator 158 may not be accessible to a user without the key, thereby substantially preventing actuation of the deadbolt arm by an unauthorized user (i.e., a user without a key). In some embodiments, the actuator may be constructed and arranged to be accessible on a secured side (e.g., interior side) of an associated door, such that an authorized user may move the deadbolt arm from the secured space without a key. Thus, operation of the deadbolt arm may be simplified while still preventing an authorized user from moving the deadbolt arm from an unsecured side (e.g., exterior side) of the associated door. In this embodiment, the actuator may be constructed and arranged as a lever, thumb turn, handle, or any other suitable structure such that the deadbolt arm can be moved by the authorized user. Of course, the actuator may also be inaccessible from both the secured and unsecured sides of the associated door without a valid credential, such that the actuator may only be actuated when the authentication device receives a valid credential (e.g., a key). Of course, any suitable combination of actuator and authentication device may be employed, such that the deadbolt arm may be moved in a locking direction or an unlocking direction by an authorized user while substantially preventing movement of the deadbolt arm by an unauthorized user.

In some embodiments, the deadbolt lock 100 may include a deadbolt backstop 157 and a deadbolt biasing member 159. The deadbolt backstop 157 may be coupled to deadbolt arm 156 by pin 155, such that the deadbolt backstop moves with the deadbolt arm. The deadbolt backstop may be coupled to a latch bolt or other lock component (not shown in the figure), such that actuation of the other lock component may cause deadbolt arm 156 to be correspondingly actuated. The deadbolt biasing member 159 may be constructed and arranged to bias the deadbolt arm in either the locking or unlocking direction. In the depicted embodiment, the biasing member biases the deadbolt arm toward the locking direction. In some embodiments, the biasing member may assist the actuator coupled to the deadbolt arm, such that the force applied by the actuator to move the deadbolt arm in the biased direction is reduced. In other embodiments, the biasing member may automatically move the deadbolt arm in the biased direction, such that the deadbolt head 150 is correspondingly moved in the extending or retracting direction. According to this embodiment, an actuator coupled to the deadbolt arm may hold the deadbolt arm in place to resist the biasing force of the biasing member, such that authentication of a valid credential at the authentication device releases the deadbolt arm to be moved by the biasing member. Of course, any suitable arrangement of the deadbolt biasing member may be employed such that the deadbolt arm is biased toward either the locking direction or unlocking direction.

FIG. 1C depicts a deadbolt 120 in a retracted position. In the retracted position, the deadbolt head 150 is contained within the lock, such that the deadbolt head is substantially inside of (i.e., not projecting out of) front plate 104. As shown in the figure, deadbolt arm 156 is moved to an unlocked position, such that a projection of the deadbolt arm is located in an upper portion of cam slot 201. From this position, the deadbolt arm may be rotated in a locking direction such that the projection of the deadbolt arm abuts the cam slot and moves the deadbolt head toward the extended position as shown in FIG. 1A.

FIG. 1B depicts a deadbolt 120 in a partially extended position, in this example, midway between an extended position and a retracted position. In this position, the deadbolt head 150 partially projects out of front plate 104 and deadbolt arm 156 is between a locked position and an unlocked position. The deadbolt arm has been moved in the locking direction in comparison to FIG. 1C, and as a result deadbolt head 150 has been partially extended. Accordingly, in this position the deadbolt head 150 would at least partially enter a strike plate or other locking surface adjacent an associated door, thereby securing the associated door. A projection of deadbolt arm 156 is operatively coupled to cam slot 201 and lower cam slot 203 of sliding mechanism 152, such that moving the deadbolt arm in the locking direction causes the projection to abut an inclined side of the cam slot to move the deadbolt head toward the extended position. That is, moving the projection in the cam slot creates a camming motion which extended or retracts the deadbolt head. In the position shown in FIG. 1B, the deadlatching arrangement (i.e., lower cam slot 203) may not prevent the deadbolt head from retracting in response to external force applied to the deadbolt head. Accordingly, the deadbolt arm may be moved in the unlocking direction by the sliding mechanism if an external force is received by the deadbolt head if the projection is not located in lower cam slot 203. Thus, even though the deadbolt arm was moved in the locking direction to extend the deadbolt, the depicted deadlatching arrangement does not substantially prevent any external force applied on the deadbolt head from moving the deadbolt toward the retracted position when the deadbolt is not in the extended position.

FIG. 1A depicts a deadbolt 120 in an extended position. In this position, a deadbolt head 150 is in the extended position, with the deadbolt head projecting out of front plate 104. According to this embodiment, the deadbolt head 150 would enter a strike plate or other locking surface adjacent an associated door, thereby securing the associated door. As shown in the figure, deadbolt arm 156 is in a locked position, with a projection of the deadbolt arm positioned in lower cam slot 203 of a sliding mechanism 152. As discussed above, the lower cam slot substantially prevents the deadbolt arm from moving in an unlocking direction in response to any external force applied to the deadbolt head. Thus, the deadbolt head remains in the extended position until the deadbolt arm 156 is moved in an unlocking direction by an authentication device 163 and/or actuator 158. Accordingly, the deadlatching arrangement (i.e., lower cam slot 203) does not prevent the deadbolt arm from moving in the unlocking direction, but does prevent movement of the deadbolt head and/or sliding mechanism from moving the deadbolt arm in the unlocking direction. However, in the depicted embodiment, the lower cam slot only prevents the deadbolt from retracting when the deadbolt head is in the extended position and the deadbolt arm is in the locked position. Accordingly, a partially extended deadbolt (see FIG. 1B) which may otherwise secure the door may be retracted by an external force applied on the deadbolt head, reducing the security of the deadbolt.

Figure 2A:
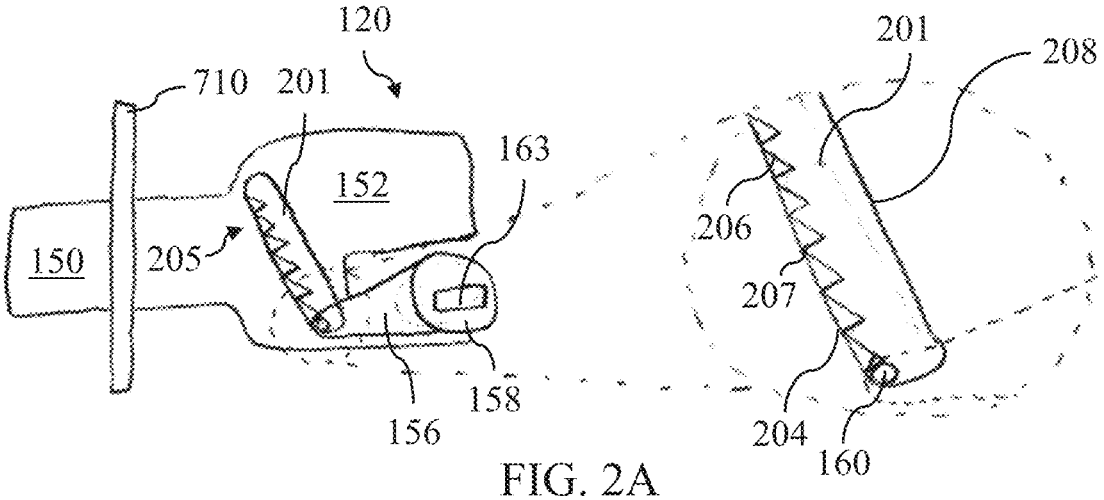
FIGS. 2A-2B are side views of one embodiment of a deadbolt incorporating a progressive deadlatching arrangement.
Figure 2B:
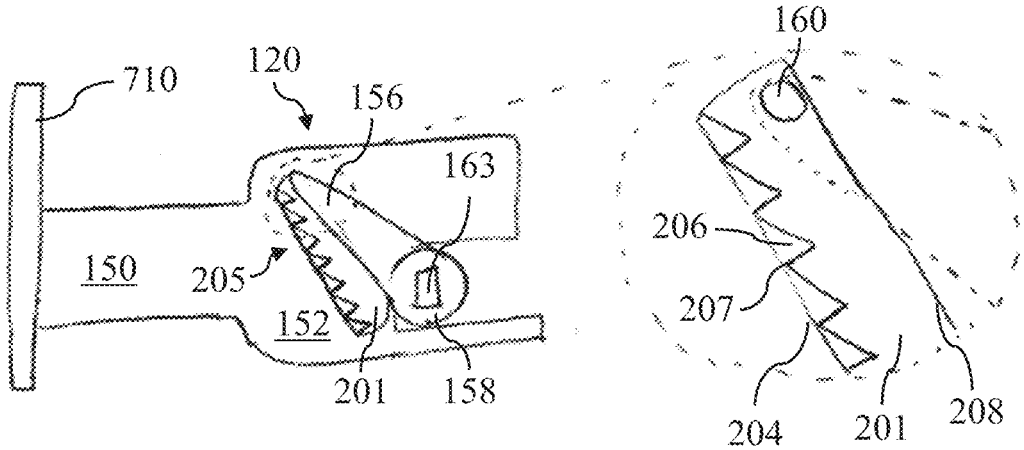

FIGS. 2A-2B depict an embodiment of a deadbolt 120 with a progressive deadlatching arrangement. In the depicted embodiment, the deadbolt is positioned in a door with side 710 (see FIGS. 9A and 9B) which is arranged to adjoin a door jamb with a strike plate (not shown in the figures) when the door is closed. The deadbolt includes a deadbolt head 150, sliding mechanism 152, and a deadbolt arm 156 which cooperate to move the deadbolt head 150 between an extended position and a retracted position. In the depicted embodiment, the sliding mechanism includes a cam slot 201 and the deadlatching arrangement is configured as a plurality of ratchet teeth 205 disposed on a first side 204 of the cam slot. The deadbolt arm includes a projection 160, which projects through the cam slot. The projection is constructed and arranged to contact the first side to move the deadbolt head in the extending direction and a second side 208 to move the deadbolt head in the retracting direction. The deadbolt also cooperates with an authentication device 163 embodied here as a key slot, and an actuator 158, each of which is disposed on the deadbolt arm 156. An authorized user may insert a key into the key slot, and rotate the key or actuator 158 to correspondingly rotate the deadbolt arm in the locking or unlocking direction.

According to the present embodiment, the deadbolt 120 includes a deadlatching arrangement configured as a plurality of ratchet teeth 205. Each ratchet tooth includes an inclined tooth portion 206 and a locking region 207. In the present embodiment, the ratchet teeth are integrally formed as a part of first side 204 of cam slot 201. Of course, the ratchet teeth 205 may be attached to the cam slot 201 by any suitable method, including but not limited to fasteners or adhesives. In the depicted embodiment, as the deadbolt arm is rotated by the authentication device 163 and/or actuator 158 in a locking direction, projection 160 abuts the ratchet teeth and slides over the inclined tooth portions as it moves along first side 204 to move deadbolt head 150 towards the extended position. As the projection moves down the first side of the cam slot, the projection acts as a pawl, which engages one of the plurality locking regions 207 as the deadbolt head is extended from the fully retracted position. That is, as the projection moves down the first side of the cam slot, the projection engages each locking region consecutively until the deadbolt arm reaches the locked position and the deadbolt head is in the fully extended position. Without wishing to be bound by theory, the plurality of locking regions 207 prevent the projection from moving in an unlocking direction while the projection is contacting the first side of the cam slot. Accordingly, as the deadbolt head is extended, it is progressively deadlatched to prevent any external force on the deadbolt head from moving the deadbolt arm in the unlocking direction. That is, any external force applied to the deadbolt head will be transmitted to the projection of the deadbolt along the first side of the cam slot, and therefore any external force is substantially prevented from moving the deadbolt arm in the unlocking direction and thus moving the deadbolt toward the retracted position. Accordingly, as the deadbolt arm is moved down the first side of the cam slot the ratchet teeth will provide progressive deadlatching, such that the deadbolt head does not need to be fully extended to have the benefits of deadlatching. Accordingly, even if a user partially extends the deadbolt head, the deadbolt will remain secure from external forces, thereby increasing the security of an associated door.

In the depicted embodiment, an authorized user may use the authentication device 163 constructed and arranged as a key slot to move the deadbolt arm in the locking or unlocking direction. In this embodiment, the reception of a valid credential at the authentication device grants an authorized user access to move the deadbolt arm in the locking or unlocking direction. Accordingly, an authorized used may insert a key in the key slot 163 and rotate the deadbolt arm in the locking direction, thereby engaging first side 204 of cam slot 201 and progressively engaging the plurality of locking regions 207 of the ratchet teeth 205. As shown in FIGS. 2A and 2B, the ratchet teeth are sufficiently large to engage the projection 160, but are small enough such that the projection does not contact the ratchet teeth when the projection contacts a second side 208 of the cam slot 201. That is, when the projection contacts the second side 208, the projection is able to move up along the second side of the cam slot as the deadbolt arm moves in the unlocking direction, thereby retracting the deadbolt head without interference from the ratchet teeth 205. According to this arrangement, a user may rotate the deadbolt arm in the unlocking direction using the authentication device 163 and/or actuator 158 to move the projection to the second side of the cam slot, thereby releasing the projection the plurality of locking regions of the ratchet teeth. The deadbolt arm may then be rotated in the unlocking direction as the projection moves along the second side of the cam slot until the deadbolt head is in the retracted position. In some cases, the deadbolt arm may be moved out of contact with the first side 204 while the deadbolt head is partially extended. In this case, external force applied on the deadbolt head may partially retract the deadbolt until the projection moves into contact with the first side, and consequently engages one of the plurality of locking regions 207. Thus, even if an authorized user rotates the deadbolt arm partially in the unlocking direction, the ratchet teeth 205 may substantially prevent the deadbolt head from moving to the retracted position. Accordingly, security of an associated door which includes the deadbolt is improved.

In the depicted embodiment, the locking regions 207 are discrete in that the quantity of locking regions is equivalent to the number of ratchet teeth 205. As discussed above, the deadlatching arrangement will provide deadlatching at one of the locking regions 207 such that the deadbolt head cannot be retracted by external force applied to the deadbolt head. In some cases, the deadbolt arm 156 may be in a position between the locked and unlocked positions where the projection 160 is contacting the first side 204 at a point that is not a locking region 207 (i.e., along inclined tooth portion 206). In this case, an external force provided on the deadbolt head may move the projection along the first side until the projection engages the next (i.e., nearest in the direction of motion of the projection) locking region positioned along the length of the first side 204 of the cam slot 201. Accordingly, when the projection engages the next locking region, the deadbolt head 150 will be prevented from further retraction, thereby providing deadlatching for the deadbolt by preventing substantial retraction of the deadbolt head. Of course, any quantity of discrete locking regions may be employed, such that the discrete locking regions substantially prevent external force on the deadbolt head from moving the deadbolt head to the retracted position.

FIG. 2A depicts an embodiment of the deadbolt 120 in the fully extended position. As shown FIG. 2A, deadbolt arm 156 is in the locked position, with the projection 160 located in a lower portion of cam slot 201 of the sliding mechanism 152. The projection is contacting a first side 204 of the cam slot, and engaging one of a plurality of locking regions 207 of the ratchet teeth 205. Accordingly, any external force applied on the deadbolt head 150 is not transmitted to the projection in a way that would move the deadbolt arm in the unlocking direction. That is, the locking region abuts the projection and prevents such a force from moving the deadbolt arm in the unlocking direction while also preventing the deadbolt head from moving in a retracting direction. To move the deadbolt head toward the retracted position, the deadbolt arm is rotated by authentication device 163 and/or actuator 158 in the unlocking direction, thereby moving the projection out of contact with the first side of the cam slot and into contact with the second side 208 of the cam slot. From this position, the deadbolt arm may be moved in the unlocking direction, with the projection moving along the second side of the cam slot to move the deadbolt to the retracted position as shown in FIG. 2B.

FIG. 2B depicts the deadbolt 120 of FIG. 2A in the retracted position. As shown in the figure, deadbolt arm 156 is in the unlocked position, with the projection 160 of the deadbolt arm in an upper portion of cam slot 201 such that the deadbolt head 150 is substantially within door side 710. The projection is contacting a second side 208 of the cam slot, such that the projection is not contacting any of the plurality of ratchet teeth 205. From this position, an authorized user may use the authentication device 163 and/or actuator 158 to rotate the deadbolt arm in the locking direction such that the projection moves out of contact with the second side and into contact with the first side. The projection may then be moved down the first side over the inclined tooth sections 206 of the ratchet teeth such that the deadbolt head is moved toward the extended position and projects out of the door side 710. As the projection moves over the first side the cam slot, the projection engages each of the plurality of the locking regions consecutively.

Figure 3A:
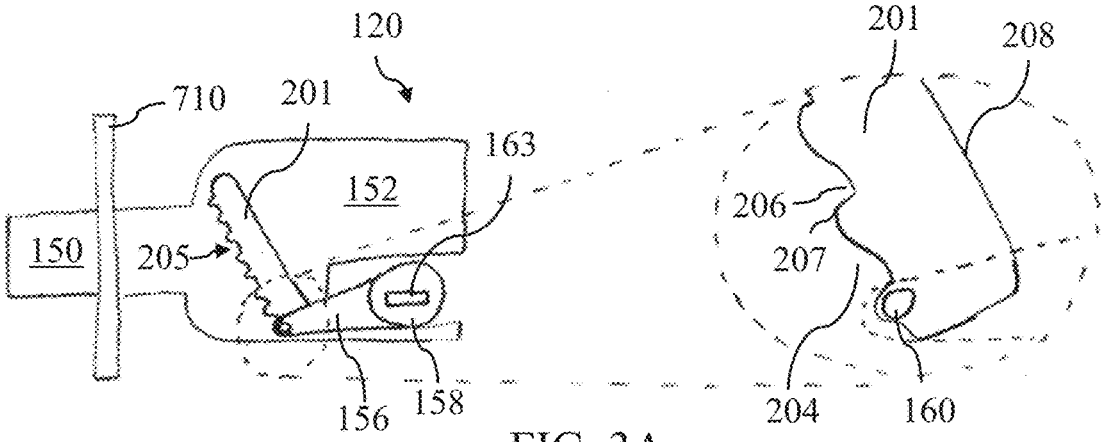
FIGS. 3A-3B are side views of yet another embodiment of a deadbolt incorporating a progressive deadlatching arrangement.
Figure 3B:
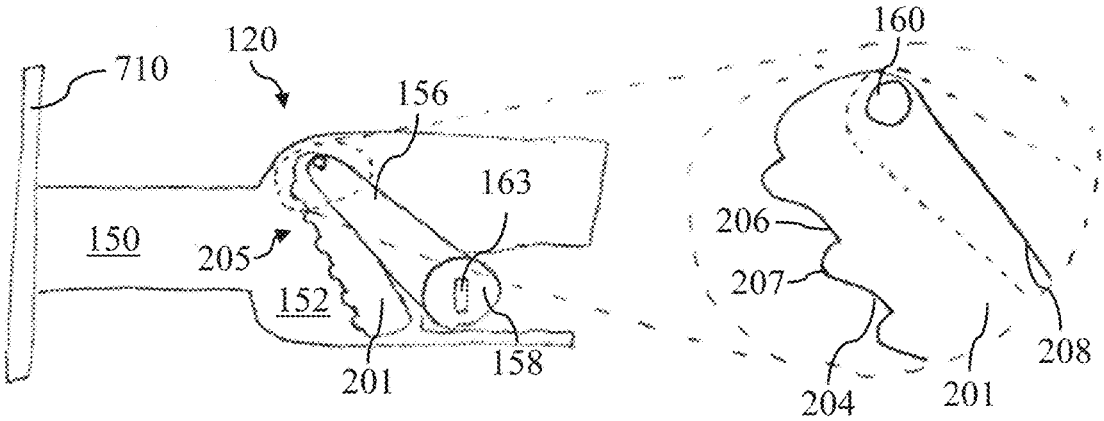

FIGS. 3A-3B depict side views of another embodiment of a deadbolt 120 with a progressive deadlatching arrangement. In the depicted embodiment, the deadbolt is mounted in a door with deadbolt head 150 constructed and arranged to project out of door side 710 (see FIGS. 9A and 9B) in the extended position and be substantially within the door side in a retracted position. The deadbolt includes the deadbolt head, sliding mechanism 152, and a deadbolt arm 156 which cooperate to move the deadbolt head 150 between the extended position and the retracted position. In the depicted embodiment, the sliding mechanism includes a cam slot 201 with a first side 204 and a second side 208. The sliding mechanism also includes a progressive deadlatching arrangement configured as a plurality of curved teeth 205 which form the first side 204 of the cam slot. The deadbolt arm includes a projection 160 constructed and arranged to project into the slot 201 and contact the first side 204 of the cam slot to move the deadbolt head toward the extended position. The projection is also constructed and arranged to contact the second side 208 to move the deadbolt head toward the retracted position. In the depicted embodiment, the deadlatching arrangement 205 permits an authorized user to retract deadbolt head 150 by moving deadbolt arm 156. The deadbolt also cooperates with an authentication device 163 embodied here as a key slot, and an actuator 158, each of which is disposed on the deadbolt arm 156. An authorized user may insert a key into the key slot, and rotate the key or actuator 158 to correspondingly rotate the deadbolt arm in the locking or unlocking direction.

According to the present embodiment, the deadbolt 120 includes a progressive deadlatching arrangement embodied as a plurality of curved teeth 205, each curved tooth having a smooth tooth portion 206 and a curvic depression which forms locking region 207. In this embodiment, the plurality of curved teeth is integrally formed with the first side 204 of the cam slot 201. In contrast to the embodiment depicted in FIGS. 2A-2B, the curved teeth are cut out from the first side, such that the locking regions 207 are recessed from first side 204. Further, without wishing to be bound by theory, the curved teeth could provide for a more secure engagement with the projection 160. When the deadbolt arm is rotated by the authentication device 163 and/or actuator 158 in a locking direction, projection 160 of the deadbolt arm 156 abuts the ratchet teeth 205 and slides over the smooth tooth portions 206 as it moves along first side 204 of the cam slot and the curvic depressions to move deadbolt head 150 towards the extended position. As the projection moves down the cam slot, the projection acts as a pawl which engages the locking regions 207 as the deadbolt head is extended. That is, as the projection moves down the first side of the cam slot, the projection engages each locking region consecutively until the deadbolt arm reaches the locked position and the deadbolt head is in the extended position. If the deadbolt head receives an external force that forces the deadbolt head in the retracting direction, one of the plurality of curvic depressions engage the projection 160 to substantially prevent retraction. Without wishing to be bound by theory, the curvic depressions may convert the external force applied to the deadbolt head to a direction along the length of the deadbolt arm, where such a direction may prevent the deadbolt arm from moving in an unlocking direction. Accordingly, the deadbolt is substantially prevented from moving toward the retracted position by the progressive deadlatching arrangement. Such an arrangement may allow the projection to be consistently captured in a locking region and increase the contact area between the projection and the locking region.

In the depicted embodiment, the authentication device 163 may be used in cooperation with the actuator 158 to move the deadbolt arm in an unlocking direction to retract the deadbolt head 150. As shown in the figure, the curvic depressions which form locking regions 207 are recessed in first side 204. Accordingly, when the projection 160 is in contact with second side 208, the projection does not contact the plurality of curved teeth 205. When the deadbolt arm 156 is rotated in the unlocking direction by the authentication device 163 and/or actuator 158, the projection is moved out of contact with the first side and any locking region it may have been positioned in. The projection 160 may then contact the second side and move up the second side to retract the deadbolt head without interference from the curved teeth. In some embodiments, the plurality of curved teeth may have a variety of different curvic depressions varying in depth, curvature, or any other suitable characteristic such that the deadbolt arm may be reliably removed from the curvic depression when moved by the authentication device or actuator. In some other embodiments, an authorized user may partially move the deadbolt arm in the locking direction to move the projection along the first side such that the projection is outside of a locking region (i.e., contacting a smooth tooth section 206). Accordingly, the deadbolt arm may be then easier to move in the unlocking position away from the first side of the cam slot. Without wishing to be bound by theory, such an arrangement may require less force to move the projection from the first side to the second side, or otherwise may be less prone to jams. Of course, any suitable arrangement of teeth in the sliding mechanism may be employed such that the deadbolt is substantially prevented from moving to the retracted position as a result of an external force applied to the deadbolt head.

FIG. 3A depicts an embodiment of the deadbolt 120 in the extended position. As shown in the figure, deadbolt arm 156 is in the locked position, with the projection 160 located in a lower portion of cam slot 201 of the sliding mechanism 152. The projection is contacting a first side 204 of the cam slot, and engaging one of a plurality of curvic depressions that form locking regions 207 of the curved teeth 205. Accordingly, any external force applied on the deadbolt head is not transmitted to the projection in a way that would move the deadbolt arm in the unlocking direction. That is, the curvic depression abuts the projection 160 and prevents such a force from moving the deadbolt arm in the unlocking direction while also preventing the deadbolt head from moving in a retracting direction. To move the deadbolt head toward the retracted position, the deadbolt arm is rotated by authentication device 163 and/or actuator 158 in the unlocking direction, thereby moving the projection out of contact with the first side of the cam slot and into contact with the second side 208 of the cam slot. From this position, the deadbolt arm may be moved in the unlocking direction to retract the deadbolt to the retracted position as shown in FIG. 3B.

FIG. 3B depict the deadbolt 120 of FIG. 3A in the retracted position. As shown in the figure, deadbolt arm 156 is in the unlocked position, with the projection 160 of the deadbolt arm in an upper portion of cam slot 201 such that the deadbolt head 150 does not project out of the door side 710. The projection is contacting a second side 208 of the cam slot, such that the projection is not contacting any of the plurality of curved teeth 205. From this position, an authorized user may use the authentication device 163 and/or actuator 158 to rotate the deadbolt arm in the locking direction such that the projection moves out of contact with the second side and into contact with the first side. The projection may then be moved down the first side over the smooth tooth sections 206 and curvic depressions such that the deadbolt head is moved toward the extended position and projects out of the door side 710.

Figure 4A:
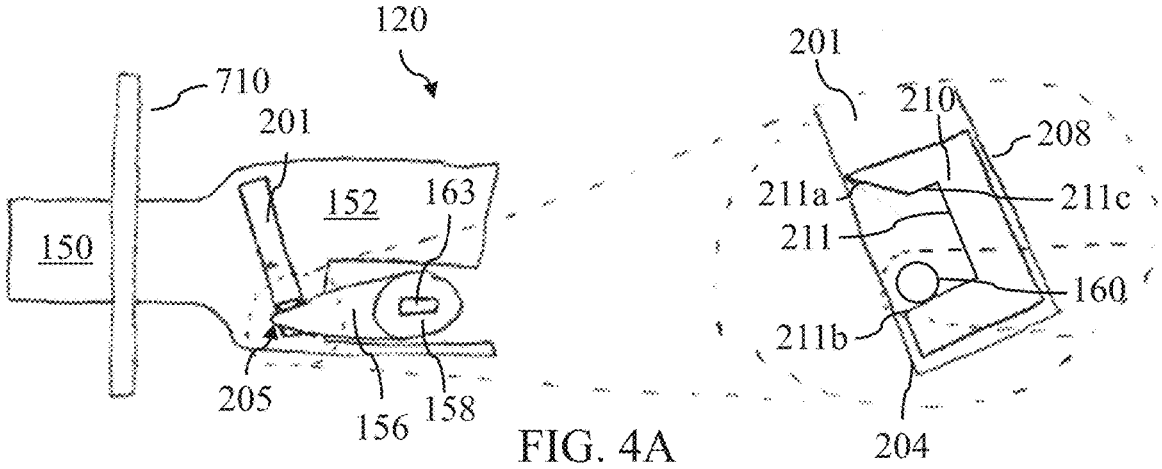
FIGS. 4A-4C are side views of yet another embodiment of a deadbolt incorporating a progressive deadlatching arrangement.
Figure 4B:
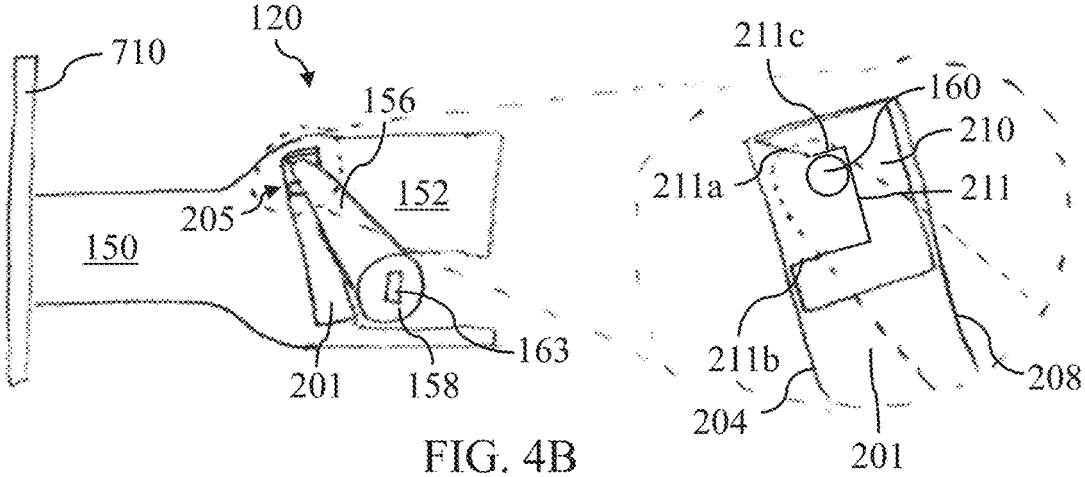
Figure 4C:
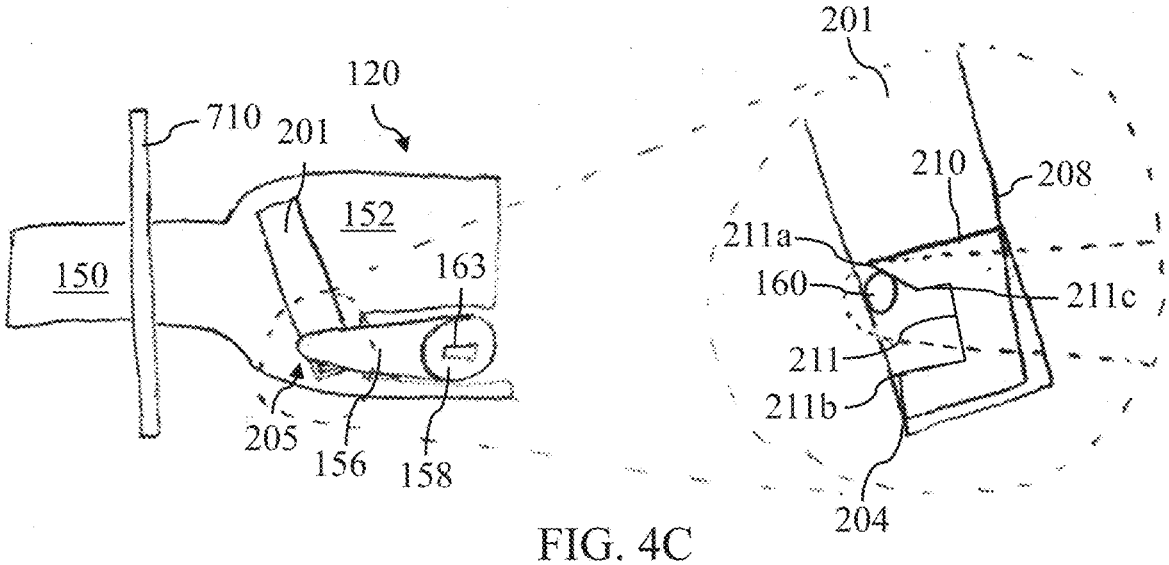

FIGS. 4A-4C depict another embodiment of a deadbolt 120 with a progressive deadlatching arrangement. In the depicted embodiment, the deadbolt is mounted in a door, with deadbolt head 150 constructed and arranged to project out of door side 710 (see FIGS. 9A and 9B) in the extended position and be within the door side in a retracted position. The deadbolt includes the deadbolt head, sliding mechanism 152, and a deadbolt arm 156 which cooperate to move the deadbolt head 150 between the extended position and the retracted position. In the depicted embodiment, the sliding mechanism includes a cam slot 201 with a first side 204 and a second side 208. In the depicted embodiment, the deadbolt includes a progressive deadlatching arrangement 205 that includes a cam block 210 and notch 211 disposed on a side of the cam block adjacent the first side of the cam slot. The notch includes an inclined side 211*a*, a flat side 211*b*, and a cutout 211*c*. The deadbolt arm 156 includes a projection 160 positioned inside of the cam slot and in between the notch 211 and first side 204. The projection is constructed and arranged to contact the notch to concurrently move the cam block along the cam slot and move the deadbolt head between the extended and retracted positions. Accordingly, when the deadbolt arm is moved in a locking direction, the projection contacts the first side of the cam slot and flat side 211*b* of the notch to move the cam block along the first side of the cam slot and move the deadbolt head toward the extended position. When the deadbolt arm is moved in an unlocking direction, the projection contacts cutout 211*c* to move the cam block along the second side, thereby creating a camming motion which moves the deadbolt head to the retracted position. In the depicted embodiment, the deadlatching arrangement 205 permits an authorized user to retract deadbolt head 150 by moving deadbolt arm 156. The deadbolt also cooperates with an authentication device 163 embodied here as a key slot, and an actuator 158, each of which is disposed on the deadbolt arm 156. An authorized user may insert a key into the key slot, and rotate the key or actuator 158 to correspondingly rotate the deadbolt arm in the locking or unlocking direction.

According to the present embodiment, the cam block 210 and notch 211 substantially prevent an external force on the deadbolt head 150 from moving the deadbolt to a retracted position. As the deadbolt arm 156 is moved in the locking direction, the projection 160 abuts the flat side 211*b* of the notch 211, which moves the cam block along the first side 204 of cam slot 201 while the projection moves the deadbolt head in the extending direction. Once the deadbolt head is at least partially extended (i.e., projecting from the door side 710), any external force on the deadbolt head will be converted to a force on the deadbolt arm which will move the projection partially up the cam slot until it contacts the inclined side 211*a* of the cam block (see FIG. 4C). As the projection moves along the first side of the cam slot to contact the inclined side of the notch, the projection becomes wedged between the inclined side of the notch and the first side of the cam slot. Accordingly, this wedging action between the projection and the cam block causes the cam block abut the first side 204 and the second side 208 of the cam slot, thereby generating significant frictional and normal forces which resist the movement of the cam block and deadbolt arm in the unlocking direction. Without wishing to be bound by theory, the wedging action of the projection between the first side of the cam slot by the inclined side is caused by the angled nature of the inclined side. That is, the inclined side is at any suitable angle such that the force in the unlocking direction provided on the cam block by the deadbolt arm in response to an external force on the deadbolt head is unsuitable to overcome the frictional forces generated by the cam block. Thus, once sufficient frictional force occurs, the deadbolt arm is prevented from moving in the unlocking direction by the cam block. Accordingly, the deadbolt head will be substantially prevented from moving toward the retracted position.

In the depicted embodiment, the cam block 210 and notch 211 allow the deadbolt head 150 to be retracted if the deadbolt arm is moved in the unlocking direction by the authentication device 163 and/or actuator 158. As the deadbolt arm is moved by the authentication device and/or actuator, the projection 160 is moved away and out of contact with the first side 204 of the cam slot 201 (see FIG. 4B). Accordingly, the projection is moved into contact with a cutout 211*c* of the notch 211 without contacting inclined side 211*a*. The cam block contacts the second side 208 of the cam slot and transmits force from the projection to the second side of the cam slot. Thus, the deadbolt arm and cam block producing a camming motion in the cam slot 201, and concurrently move up the cam slot such that the deadbolt head 150 is retracted. Without wishing to be bound by theory, the direction of the force provided by deadbolt arm when actuated by the authentication device or actuator is in the direction of the second side of the cam slot, such that the wedging action between the projection and the inclined side 211*a* does not occur. In this embodiment, the projection contacts the notch cutout 211*c* located at the base of the inclined section, such that the projection is kept out of contact with the first side of the cam slot and the inclined side 211*a* so as to not cause a wedging action and therefor promote a consistent motion between the extended and retracted positions. Of course, the cam block may have a notch in any suitable arrangement that substantially prevents force applied on the deadbolt head from moving the deadbolt head to the retracted position, while allowing independent movement of the deadbolt arm in the unlocking direction to retract the deadbolt head. In some embodiments, following a wedging action the deadbolt arm may be moved in a locking direction independent of the deadbolt head such that the projection is moved out of contact with at least one of the cam block and the first side of the cam slot. Following the movement of the projection out of the wedge (i.e., out of contact with at least one of the cam block and first side of the cam slot), the deadbolt arm may then be moved in unlocking direction such that the projection is brought into contact with the cam block at the notch to retract the deadbolt without causing a wedging action.

According to the present embodiment, the progressive deadlatching arrangement 205 including a cam block 210 and a notch 211 may not have discrete locking regions, but rather a continuous number of locking regions along the length of the cam slot 201. In contrast to the embodiments depicted in FIGS. 2A-2B and 3A-3B, the progressive deadlatching arrangement may resist the retraction of the deadbolt at any region along the cam slot, and is not limited to discrete locking regions as is the case with a toothed arrangement. That is, regardless of the original position of the deadbolt arm in the cam slot, the projection 160 will wedge between the inclined side 211*a* of the notch to prevent deadbolt retraction by external force. Such an arrangement may be more difficult to defeat, as the deadbolt arm does not engage a discrete predetermined region to achieve progressive deadlatching, thereby increasing security of an associated door.

As shown in FIG. 4A, the deadbolt 120 is in the extended position. Additionally, deadbolt arm 156 is in the locked position, with the projection 160 and cam block 210 located in a lower portion of cam slot 201 of the sliding mechanism 152. As discussed above, the projection is contacting a first side 204 of the cam slot and a flat side 211*b* of a notch 211 position in the cam block 210. In this position, any external force applied on the deadbolt head will be transmitted to the projection such that the projection moves up the first side to wedge between the inclined side 211*a* of the notch 211, thereby preventing additional movement of the deadbolt arm in the unlocking direction as shown in FIG. 4C. To move the deadbolt head toward the retracted position, the deadbolt arm is rotated by authentication device 163 and/or actuator 158 in the unlocking direction, thereby moving the projection out of contact with the first side of the cam slot and into contact with the notch 211 which transmits the force through the cam block to the second side 208. In this position, the deadbolt arm may be moved in the unlocking direction without causing a wedging action to retract the deadbolt to the retracted position as shown in FIG. 4B.

FIG. 4B depicts the deadbolt 120 of FIG. 4A in the retracted position. As shown in the figure and discussed above, deadbolt arm 156 is in the unlocked position, with the projection 160 of the deadbolt arm and the cam block 210 in an upper portion of cam slot 201 such that the deadbolt head 150 does not project out of the door side 710. The projection is contacting a cutout 211*c* of the notch 211 of the cam block, such that the projection is not contacting the first side 204 of the cam slot or the inclined side 211*a* of the cam block. From this position, an authorized user may use the authentication device 163 and/or actuator 158 to rotate the deadbolt arm in the locking direction such that the projection moves into contact with flat side 211*b* of the notch and first side 204 of the cam slot. The projection may then be moved down the first side concurrently with the cam block such that the deadbolt head is moved toward the extended position and projects out of the door side 710.

FIG. 4C depicts the deadbolt 120 of FIG. 4A-4B in the extended position, with the projection 160 wedged between an inclined side 211*a* of the notch 211 and a first side 204 of the cam slot 201. As shown in the figure, cam block 210 is in a wedged position, with the projection contacting the inclined side of the notch and forcing the cam block to impact the first side and second side of the cam slot. Accordingly, any additional force placed on the deadbolt head causes additional wedging action of the projection, transmitting the force into the first side and second sides of the cam slot and substantially preventing the projection from moving further along the first side of the cam slot in the unlocking direction. Accordingly, the wedging action of the projection between the first side 204 and inclined side 211*a* substantially prevents the deadbolt head from moving in a retracting direction.

Figure 5:
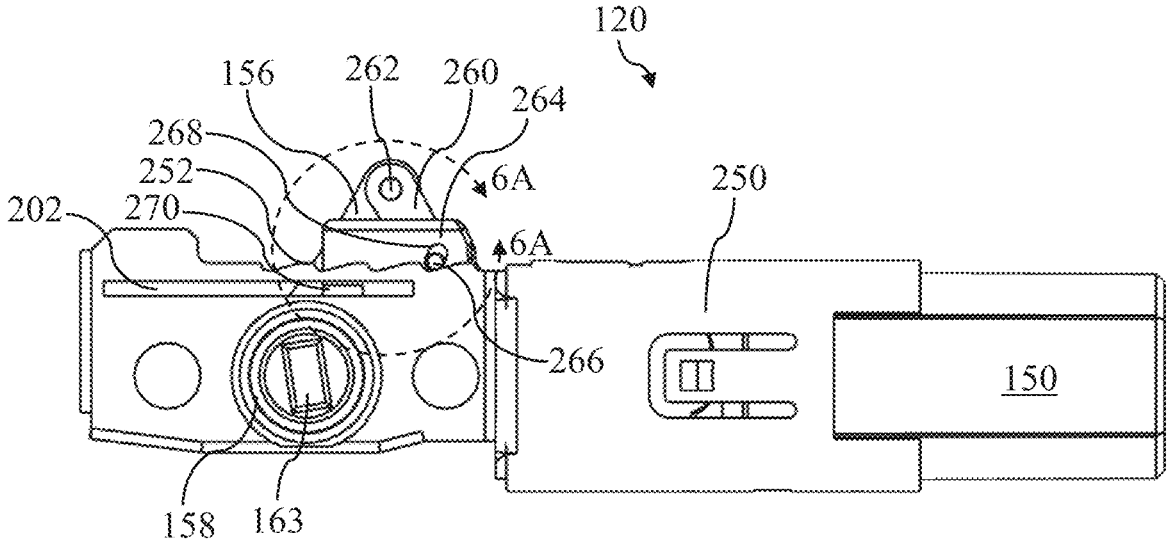
FIG. 5 is a side view of yet another embodiment of a deadbolt incorporating a progressive deadlatching arrangement.

FIG. 5 depicts yet another embodiment of a deadbolt 120 including a progressive deadlatching arrangement. Similar to previously described embodiments, the deadbolt includes a deadbolt head 150 which is moved between an extended position and a retracted positioned by a deadbolt arm 156. In particular, the deadbolt arm is moved by an actuator 158 operatively connected to a slot 163 and the deadbolt arm 156. As discussed previously, the slot is arranged to receive a similarly shaped bar (not shown in the figure) which is rotatable by an authorized user to move the actuator, thereby transferring the motion of the shaped bar to the deadbolt arm to move the deadbolt arm in a locking or unlocking direction. Those skilled in the art will appreciate that the shaped bar may be actuated with a physical key or through an automated actuator or the actuator 158 may be directed actuated with the automated actuator.

According to the embodiment shown in FIG. 5, the actuator 158 and deadbolt head 150 are operatively coupled to a deadbolt guide 250 which may be mounted in a deadbolt lock chassis. The deadbolt guide facilitates rotation of the actuator between unlocked and locked positions and movement of the deadbolt head between the extended and retracted positions. The deadbolt guide includes a slot 202 which receives a tab 270 connected to the deadbolt head. That is, the tab 270 is disposed on a deadbolt head linkage 264 which is attached to the deadbolt head, so that the tab moves along the slot 202 when the deadbolt head moves between the extended position and the retracted position.

Continuing with FIG. 5, the deadbolt arm 156 is rotatably coupled to a deadlatching arm 260 via pin 262. Accordingly, the deadbolt arm and deadlatching arm form a two bar linkage. The deadlatching arm 260 is coupled to the deadbolt head linkage 264 via deadlatching pin 266 which is disposed in a deadlatching slot 268 formed in the deadbolt head linkage. Thus, when the deadbolt arm 156 rotates (e.g., by actuation of the actuator 158), the deadlatching arm 260 may apply a force to the deadbolt head in an extension direction or retraction direction. In the two-bar linkage arrangement shown in FIG. 5, when the deadbolt arm moves the deadbolt arm in an extension direction, the deadlatching pin 266 moves toward a bottommost portion of the deadlatching slot, whereas when the deadbolt arm moves the deadbolt arm in a retraction direction the deadlatching pin moves toward an uppermost portion of the deadlatching slot. When the deadlatching pin moves toward the bottommost portion of the deadlatching slot, it may be aligned with a locking region 252 (e.g., ratchet tooth) disposed on the deadbolt guide. In contrast, when the deadlatching pin moves toward the uppermost region of the deadlatching slot, the pin may clear any locking regions so that movement of the deadbolt head is not restricted. Such an arrangement allows the deadbolt head to be progressively deadlatched as the deadbolt head is extended without compromising the retraction of the deadbolt via actuator 158, as will be discussed further with reference to FIGS. 6A-6B.

Figure 6A:
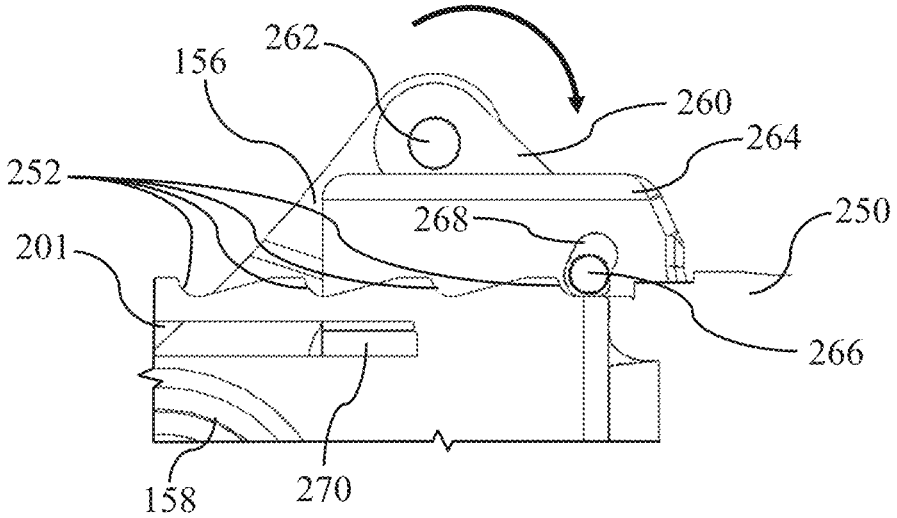
FIG. 6A is an enlarged view of area encircled by line 6A-6A of FIG. 5 as the deadbolt head is moved toward the extended position.
Figure 6B:
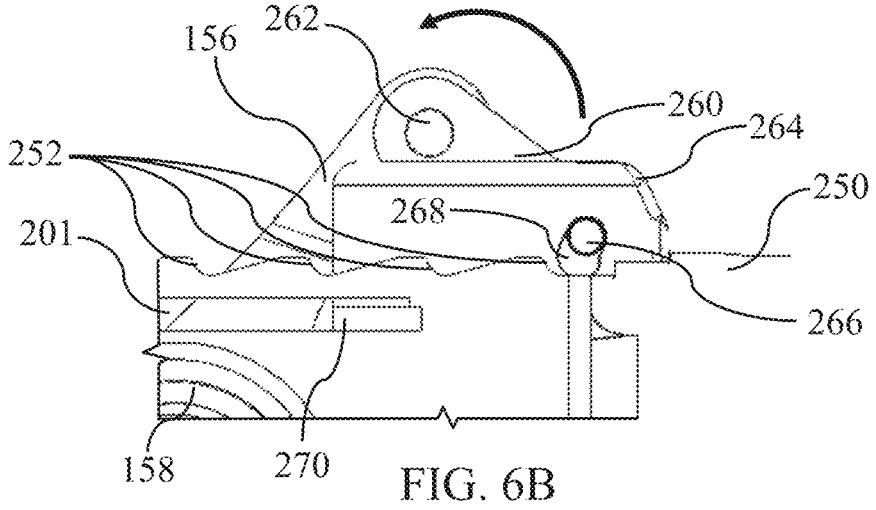
FIG. 6B is an enlarged view of the deadlatching arrangement as the deadbolt head is moved toward the retracted position.

FIGS. 6A-6B depict enlarged views of the deadbolt deadlatching arrangement of FIG. 6. FIG. 6A shows the deadbolt as the deadbolt head is moved toward the extended position. According to the state shown in FIG. 6A, the deadbolt arm 156 has been moved in a locking direction by the actuator 158, as indicated by the arrow. Force is transferred to the deadlatching arm 260 via pin 262. The deadlatching arm 260 applies a force to the deadbolt head linkage 264 which moves the deadbolt head toward the extended position. The force applied from the deadlatching arm to the deadbolt head is transmitted through the deadlatching pin 266 which abuts the deadlatching slot 268. As the force is transmitted along the deadlatching arm, the deadlatching pin is moved toward a bottommost portion of the deadlatching slot as the deadbolt head moves toward the extended position. When the deadlatching pin is moved towards the bottommost portion of the slot, the deadlatching pin is aligned with locking regions 252 configured as ratchet teeth. Accordingly, if a force is applied to the deadbolt head which would move the deadbolt head toward the retracted position, the deadlatching pin engages the nearest locking region 252 so that movement of the deadbolt head toward the retracted position is inhibited.

FIG. 6B depicts an enlarged view of the deadlatching arrangement as the deadbolt head is moved toward the retracted position. As discussed previously, when the deadbolt head is moved toward the extended position the deadlatching pin is moved into a position which aligns the deadlatching pin with the locking regions 252 so that force applied directly to the deadbolt head may not retract the deadbolt head. Accordingly, in the state shown in FIG. 6B, the deadbolt arm 156 is moved in an unlocking direction (e.g., by actuator 158) to move the deadlatching pin out of alignment with the locking regions. That is, as the deadbolt arm 156 is moved in an unlocking direction, as indicated by the arrow, the deadlatching arm 260 is moved upward by the pin 262. Correspondingly, the deadlatching pin 266 is moved up the deadlatching slot 268 towards an uppermost portion of the deadlatching slot. Accordingly, as the deadlatching pin is moved up the deadlatching slot and out of alignment with the locking regions, the deadbolt head may be moved towards the retracted position by the deadbolt arm.

In some embodiments, the deadlatching arm may be configured to be biased (e.g., via gravity or a spring) so that the deadlatching pin is in alignment with the locking regions when no force is applied via the deadbolt arm. That is, in some embodiments, the deadlatching arm may fall by gravity so that the deadlatching pin moves towards the bottommost portion of the deadlatching slot when no force is drawing the deadlatching pin toward the uppermost portion of the deadlatching slot. Such an arrangement may be beneficial to ensure deadlatching security when the deadbolt arm is moved in an unlocking direction but the deadbolt is not moved fully to the retracted position.

Figure 7A:
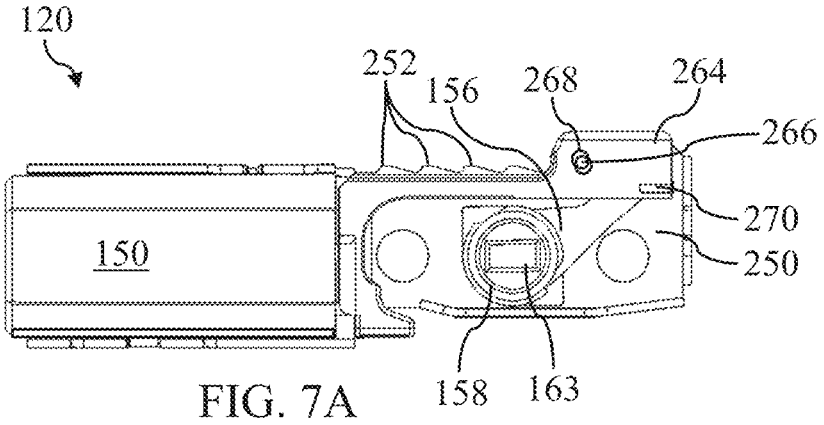
FIGS. 7A-7C are side views of the deadbolt of FIG. 5 moving from a retracted position to an extended position.
Figure 7B:
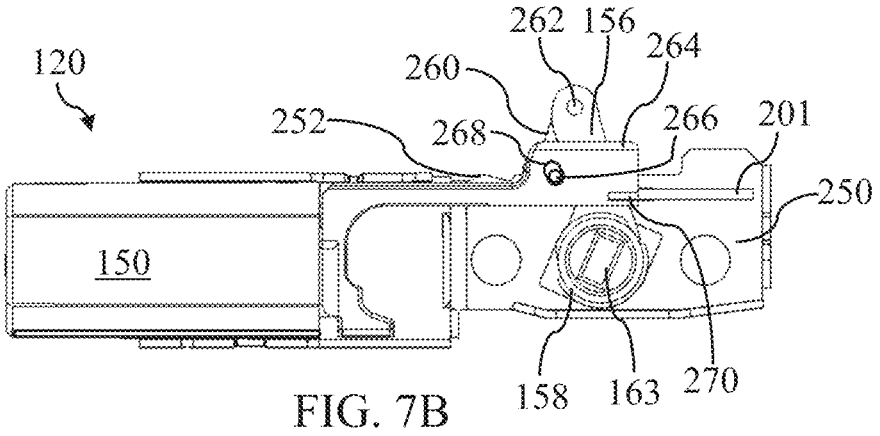
Figure 7C:
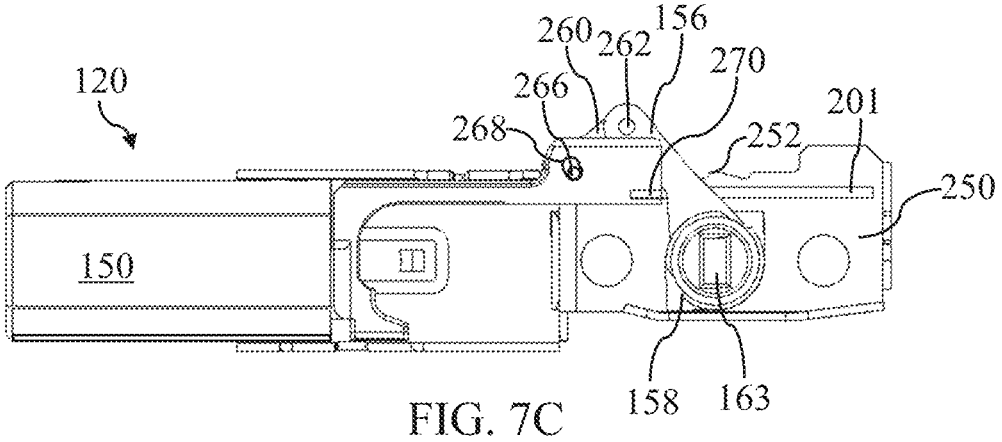

FIGS. 7A-7C show rearviews of the deadbolt 120 of FIG. 6 in various states as the deadbolt head 150 is moved from a retracted position to an extended position. As shown in FIG. 7A, the deadbolt head 150 is in a retracted position, the deadbolt arm 156 is in an unlocked position, and the deadlatching pin 266 is not engaged with any locking regions. FIG. 7B shows the deadbolt head in a position between the extended position and retracted position. As shown in FIG. 7B, the deadbolt arm 156 has been moved in a locking direction, transmitting force to the deadbolt head via deadlatching arm 260, deadlatching pin 266, and deadbolt head linkage 264. Accordingly, the deadlatching pin 266 has been moved toward a bottommost portion of the deadlatching slot 268 and is therefore aligned with a locking region 252 disposed on the deadbolt guide 250. Accordingly, if the deadbolt arm was stopped in the position shown in FIG. 7B, the deadbolt would still be secure from any externally applied force to the deadbolt head, as the deadlatching pin would engage the nearest locking region to prevent movement of the deadbolt head toward the retracted position. FIG. 7C depicts the deadbolt head 150 in the extended position with the deadbolt arm correspondingly in the locked position. Similarly to the position show in FIG. 7B, deadlatching pin 266 is aligned with locking regions 252 which prevent any external force applied to the deadbolt from retracting the deadbolt.

Figure 8B:
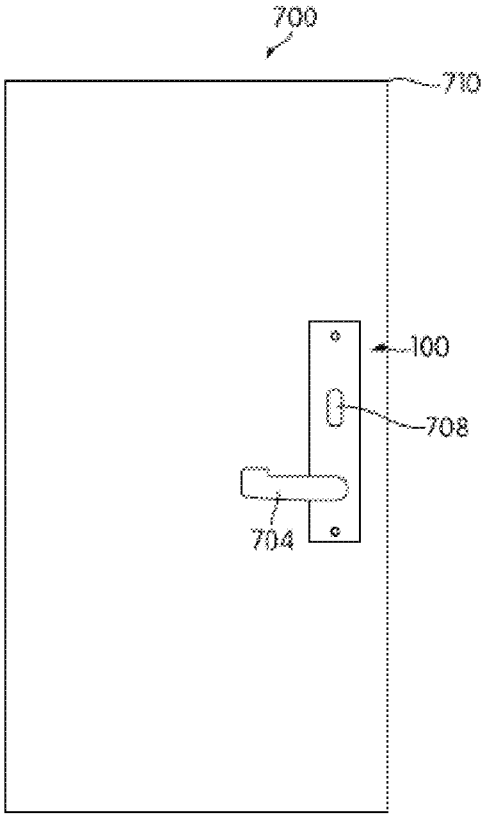
FIGS. 8A-8B depict an embodiment of a door including a deadbolt lock.
Figure 8A:
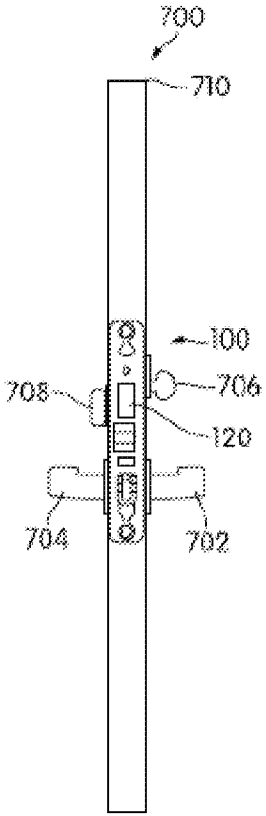

FIGS. 8A-8B depict an embodiment of a door 700 including a deadbolt lock 100 having a progressive deadlatching arrangement. The door includes a door side 710, inside of which is mounted the deadbolt lock 100 including the deadbolt. The door side is constructed and arranged to meet with a door jamb with the door is closed, thereby allowing the deadbolt 120 to secure the door. As shown in FIG. 8A, the deadbolt lock 100 includes the deadbolt 120, depicted here in use with a key 706 serving as a valid credential for an authentication device included in the deadbolt lock. The deadbolt lock also includes a deadbolt handle, which is positioned on an interior (i.e., secured) side of the door and is operatively coupled to an actuator of the deadbolt. Accordingly, an authorized user may use the deadbolt handle to actuate the deadbolt between an extended and a retracted position to secure the door. As shown in the figure, the latch assembly also includes an exterior handle 702 and an interior handle 704, which may be coupled to a latch for opening or closing the door. FIG. 8B depicts another view of the interior side of the door of FIG. 8A, with deadbolt handle 708 and interior handle 704 shown connected to the deadbolt lock 100. In some embodiments, the deadbolt handle 708 may be operated from the secured space without use of the authentication device, such that operation of the deadbolt lock may be simplified.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A deadbolt for an access point, the deadbolt comprising:

a deadbolt head constructed and arranged to move between an extended position and a retracted position;

a deadbolt arm constructed and arranged to move in a locking direction and an unlocking direction, wherein moving the deadbolt arm in the locking direction moves the deadbolt head from the retracted position to the extended position, and wherein moving the deadbolt arm in the unlocking direction moves the deadbolt head from the extended position to the retracted position; and a progressive deadlatching arrangement cooperating with the deadbolt arm, the progressive deadlatching arrangement comprising a plurality of locking regions, wherein the plurality of locking regions are constructed and arranged to engage the deadbolt arm when the deadbolt head is initially moved toward the retracted position by a force applied to the deadbolt head in a direction toward the retracted position, and wherein the plurality of locking regions are constructed and arranged to substantially prevent the deadbolt head from continuing to move toward the retracted position.

2. The deadbolt of claim 1, wherein the progressive deadlatching arrangement further comprises a plurality of ratchet teeth, wherein the plurality of ratchet teeth define the plurality of locking regions.

3. The deadbolt of claim 1, wherein the progressive deadlatching arrangement further comprises a plurality of curved teeth, wherein the plurality of curved teeth define the plurality of locking regions.

4. The deadbolt of claim 1, wherein moving the deadbolt arm independent of the deadbolt head in the unlocking direction disengages the deadbolt arm from the plurality of locking regions.

5. The deadbolt of claim 1, wherein the progressive deadlatching arrangement further comprises a deadlatching arm rotatably coupled to the deadbolt arm, wherein the deadlatching arm includes a deadlatching pin configured to engage one of the plurality of locking regions.

6. The deadbolt of claim 5, wherein the progressive deadlatching arrangement further comprises a plurality of ratchet teeth, wherein the plurality of ratchet teeth define the plurality of locking regions.

7. A deadbolt lock for an access point, the deadbolt lock comprising:

a chassis;

a deadbolt supported by the chassis, the deadbolt comprising:

a deadbolt head constructed and arranged to move between an extended position and a retracted position;

a deadbolt arm constructed and arranged to move in a locking direction and an unlocking direction, wherein moving the deadbolt arm in the locking direction moves the deadbolt head from the retracted position to the extended position, and wherein moving the deadbolt arm in the unlocking direction moves the deadbolt head from the extended position to the retracted position; and a progressive deadlatching arrangement cooperating with the deadbolt arm, the progressive deadlatching arrangement comprising a plurality of locking regions, wherein the plurality of locking regions are constructed and arranged to engage the deadbolt arm when the deadbolt head is initially moved toward the retracted position by a force applied to the deadbolt head in a direction toward the retracted position, and wherein the plurality of locking regions are constructed and arranged to substantially prevent the deadbolt head from continuing to move toward the retracted position.

8. The deadbolt lock of claim 7, wherein the progressive deadlatching arrangement further comprises a plurality of ratchet teeth, wherein the plurality of ratchet teeth define the plurality of locking regions.

9. The deadbolt lock of claim 7, wherein the progressive deadlatching arrangement further comprises a plurality of curved teeth, wherein the plurality of curved teeth define the plurality of locking regions.

10. The deadbolt lock of claim 7, further comprising an authentication device, the authentication device constructed and arranged to receive a valid credential from an authorized user, wherein reception of the valid credential allows the authorized user to move the deadbolt arm in the locking or the unlocking direction.

11. The deadbolt lock of claim 10, wherein the valid credential comprises at least one of a key, code, password, RFID, biometric reading, blockchain private key, or smart phone identifier.

12. The deadbolt lock of claim 10, further comprising an actuator operatively connected to the deadbolt arm, the actuator constructed and arranged to cooperate with the authentication device to move the deadbolt arm in the locking or unlocking direction.

13. The deadbolt lock of claim 12, wherein reception of the valid credential by the authentication device triggers the actuator to move the deadbolt arm in the locking or unlocking direction.

14. The deadbolt lock of claim 7, wherein moving the deadbolt arm independent of the deadbolt head in the unlocking direction disengages the deadbolt arm from the plurality of locking regions.

15. The deadbolt lock of claim 7, wherein the progressive deadlatching arrangement further comprises a deadlatching arm rotatably coupled to the deadbolt arm, wherein the deadlatching arm includes a deadlatching pin configured to engage one of the plurality of locking regions.

16. The deadbolt lock of claim 15, wherein the progressive deadlatching arrangement further comprises a plurality of ratchet teeth, wherein the plurality of ratchet teeth define the plurality of locking regions.

17. A door system in combination with the deadbolt lock of claim 7, the combination comprising:

a door, said deadbolt lock coupled to said door; and a first handle coupled to said deadbolt lock and operable to open said door.

* * * * *